US005325914A

United States Patent [19]

Tanaka

[11] Patent Number: 5,325,914

[45] Date of Patent: Jul. 5, 1994

[54] MOUNTING BRACKET FOR A HEAT EXCHANGER

[75] Inventor: Hiroshi Tanaka, Isesaki, Japan

[73] Assignee: Sanden Corporation, Isesaki, Japan

[21] Appl. No.: 108,507

[22] Filed: Aug. 18, 1993

[30] Foreign Application Priority Data

Aug. 27, 1992 [JP] Japan ..... 4-060324

[51] Int. Cl.[5] ..... F28F 9/00

[52] U.S. Cl. ..... 165/67; 165/149

[58] Field of Search ..... 165/67, 149; 180/68.4

[56] References Cited

U.S. PATENT DOCUMENTS

| | | | |
|---|---|---|---|
| 1,452,523 | 4/1923 | Ostrander | 228/139 |
| 1,698,271 | 10/1928 | Young | 165/149 |
| 2,103,105 | 12/1937 | Young | 165/149 X |
| 2,108,223 | 12/1938 | Young | 165/149 X |
| 4,265,225 | 5/1981 | Berger et al. | 126/445 |
| 4,529,034 | 7/1985 | Saperstein | 165/134.1 |
| 4,569,390 | 2/1986 | Knowlton et al. | 165/149 |
| 4,651,816 | 3/1987 | Struss et al. | 165/76 |
| 4,678,026 | 7/1987 | Lenz et al. | 165/67 |
| 4,738,308 | 4/1988 | Moranne | 165/149 |
| 4,938,284 | 7/1990 | Howells | 165/149 |
| 5,127,466 | 7/1992 | Ando | 165/67 |
| 5,236,042 | 8/1993 | Kado | 165/149 |

FOREIGN PATENT DOCUMENTS

| | | | |
|---|---|---|---|
| 814744 | 9/1951 | Fed. Rep. of Germany | 165/149 |

*Primary Examiner*—Allen J. Flanigan
*Attorney, Agent, or Firm*—Baker & Botts

[57] ABSTRACT

A heat exchanger includes a pair of header pipes, a plurality of parallel heat transfer tubes fluidly interconnected between the header pipes, a plurality of fin units extending between adjacent heat transfer tubes. At least one bracket is provided for each of the header pipes. The bracket supports the header pipe and has a plurality of attachment holes for attaching the bracket to an external member via fasteners inserted through the holes. Each of the attachment holes is located at a position between adjacent heat transfer tubes and between the at least one of the header pipes and the end portion of one of the fin units. The total width of the heat exchanger including the bracket can be decreased or the area of the effective heat exchanger region equipped with the fin units can be increased by this positioning of the attachment holes.

8 Claims, 4 Drawing Sheets

MOUNTING BRACKET FOR A HEAT EXCHANGER

BACKGROUND OF THE INVENTION

1. Field of the Invention

The present invention relates to a mounting bracket for a heat exchanger, such as a parallel flow type condenser for use in an air conditioner for vehicles.

2. Description of the Prior Art

FIGS. 7 and 8 show conventional heat exchangers (condensers) and the structure of a mounting bracket for the heat exchanger disclosed in Japanese Utility Model Laid-Open HEI-2-32421. In this heat exchanger, a plurality of parallel heat transfer tubes 21 are disposed between a pair of header pipes 22 extending in parallel relation to each other. Corrugated fin units 23 extend between heat transfer tubes 21. A bracket 24 is provided outside of each header pipe 22, and the bracket 24 is constructed integrally with the header pipe 22, as shown in FIG. 8. A plurality of attachment holes 25 are provided in each bracket 24, as shown in FIG. 7. Bracket 24 is attached to an external member 26 via fasteners, for example, bolts 27 and nuts 28, as shown in FIG. 8.

Generally, in such heat exchangers, effective heat exchange occurs in the region equipped with fin units 23. In the above structure of a bracket, however, because attachment holes 25 are provided on the outside of each header pipe 22, the regions between the attachment holes 25 and the end portions of fin units 23 are formed as dead spaces in which no effective heat exchange occurs.

SUMMARY OF THE INVENTION

Accordingly, an object of the present invention is to provide a structure of a mounting bracket for a heat exchanger which can decrease the total width of the heat exchanger including the bracket, such that the area of the region equipped with fin units is designed to be equal to that of a conventional heat exchanger and the heat exchange capability and capacity thereof is designed to be substantially equal to that of the conventional heat exchanger. The structure of the mounting bracket can increase the heat exchange capability and capacity by increasing the area of the region equipped with fin units, such that the total width of the heat exchanger is designed to be equal to that of a conventional heat exchanger.

To achieve this object, the structure of a mounting bracket for a heat exchanger according to the present invention is herein provided. The structure includes a pair of header pipes extending in parallel relation to each other, a plurality of parallel heat transfer tubes fluidly interconnected between the pair of header pipes, a plurality of fin units extending between adjacent heat transfer tubes of the plurality of parallel heat transfer tubes, and at least one bracket. The bracket supports the header pipe enclosed therein. Further, the bracket has a plurality of attachment holes for attaching the bracket to an external member via fasteners inserted through the attachment holes. Each of the plurality of attachment holes is located at a position between the adjacent heat transfer tubes and between the header pipe and an end portion of one of the fin units. Such a bracket is preferably provided for each header pipe.

In the structure according to the present invention, the attachment holes are disposed inside of the header pipe, more specifically, disposed in the area between the header pipe and the end portions of the fin units. This area between the header pipe and the end portions of the fin units is substantially unutilized for heat exchange in a conventional heat exchanger. Because the attachment holes are disposed on this area, if the area of the region equipped with fin units is designed to be equal to that of a conventional heat exchanger, i.e., if the length of each fin unit in a direction along the heat transfer tubes is designed to be substantially equal to that of the conventional heat exchanger, the total width of the heat exchanger including the bracket, i.e., the width between the outer end of one bracket and the outer end of another bracket, can be decreased as compared with that of the conventional heat exchanger. Therefore, in this case, the size of the heat exchanger can be decreased while maintaining a heat exchange capability and capacity equal to that of the conventional heat exchanger. On the other hand, if the total width of the heat exchanger is designed to be equal to that of a conventional heat exchanger, the length of each fin unit in a direction along the heat transfer tubes can be increased and the size of the region equipped with fin units, i.e., the effective heat exchange region, can be increased. Therefore, the heat exchange capability and capacity can also be increased.

Other objects, features, and advantages will be apparent when the detailed description of the invention and the drawings are considered.

BRIEF DESCRIPTION OF THE DRAWINGS

Some preferred exemplary embodiments of the invention will now be described with reference to the accompanying drawings, which are given by way of example only, and are not intended to limit the present invention.

DETAILED DESCRIPTION OF THE PREFERRED EMBODIMENTS OF THE INVENTION

Figure 1:
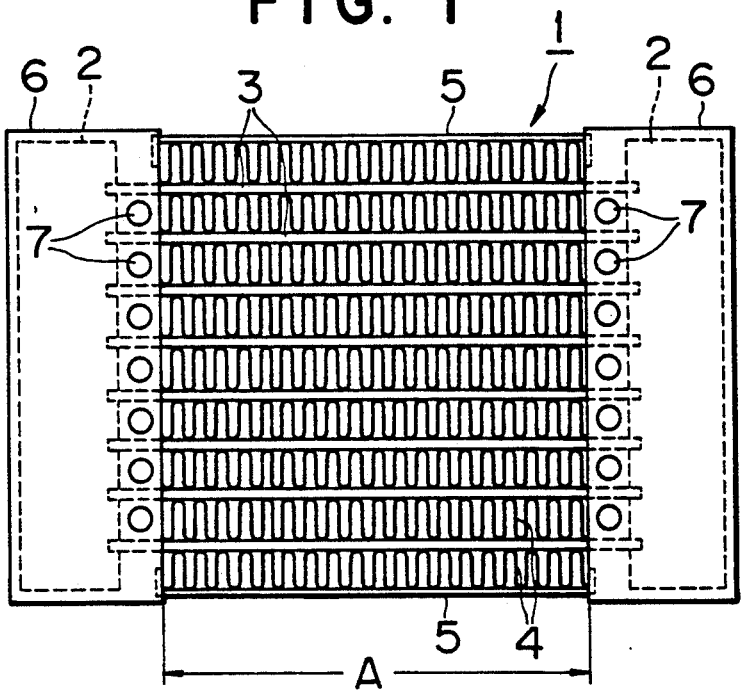
FIG. 1 is an elevational view of a heat exchanger with mounting brackets according to a first embodiment of the present invention.
Figure 2:
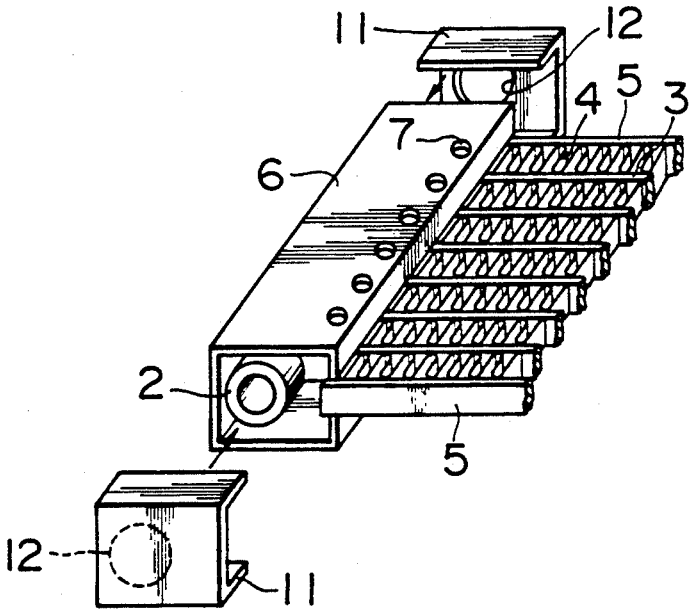
FIG. 2 is an exploded perspective view of a part of the heat exchanger shown in FIG. 1.
Figure 3:
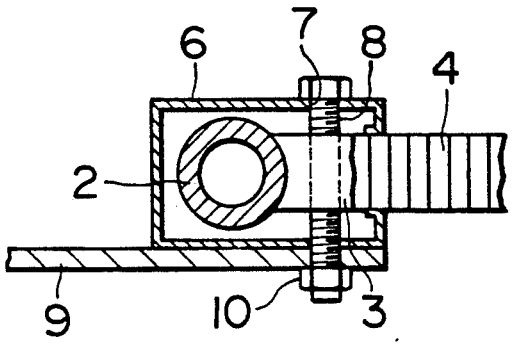
FIG. 3 is an enlarged cross-sectional view of the portion of a header pipe and a mounting bracket of the heat exchanger shown in FIG. 2.

Referring to the drawings, wherein like numerals indicate like elements, FIGS. 1 to 3 illustrate a heat exchanger with mounting brackets according to a first embodiment of the present invention. Heat exchanger 1 is constructed as a multi-flow type heat exchanger, such as a parallel flow type condenser, for use in an air conditioner for vehicles. Heat exchanger 1 has a pair of header pipes 2 extending in parallel relation to each other. A plurality of substantially parallel flat heat transfer tubes 3 are disposed between the pair of header pipes 2. Heat transfer tubes 3 are in fluid communication with header pipes 2. A plurality of corrugated fin units 4 alternate with heat transfer tubes 3, such that each corrugated fin unit 4 is positioned between two adjacent heat transfer tubes 3. The corrugated fin units may be brazed to the heat transfer tubes for permanent assembly. End plates 5 are provided on outer sides of both outer fin units 4. These header pipes 2, flat heat transfer tubes 3, corrugated fin units 4 and end plates 5 constitute the heat exchanger body.

A bracket 6 is provided for each header pipe 2. Bracket 6 may be constructed from a plate material, such as a bent metal plate or a molded resin plate, and formed with a U-shaped cross-section in this embodiment. Each bracket 6 supports one header pipe 2 enclosed therein. Bracket 6 has a plurality of linearly arranged attachment holes 7. Each attachment hole 7 is positioned between two adjacent heat transfer tubes 3 and between header pipe 2 and fin unit 4 positioned between the two adjacent heat transfer tubes 3. In one embodiment, attachment holes 7 may be positioned between every two adjacent heat transfer tubes 3.

Bolts 8 provided as fasteners are inserted into and through respective attachment holes 7, as shown in FIG. 3. Bracket 6 is attached to an external member 9, such as a structural member of a vehicle, via bolts 8 and nuts 10.

A holder 11 is provided for each end portion of each header pipe 2. Holder 11 may be U-shaped in cross-section and has a circular recessed portion 12 on the inner surface of the bottom wall of holder 11. Holder 11 is inserted into bracket 6 at the longitudinal end portion of the bracket 6. The longitudinal end portion of each header pipe 2 is inserted into recessed portion 12 of each holder 11. The end portion of each header pipe 2 is supported by each holder 11 and each holder 11 is supported by bracket 6. Bracket 6 supports header pipe 2 via holder 11 and bracket 6 is attached to external member 9 via bolts 8 and nuts 10.

Figure 4:
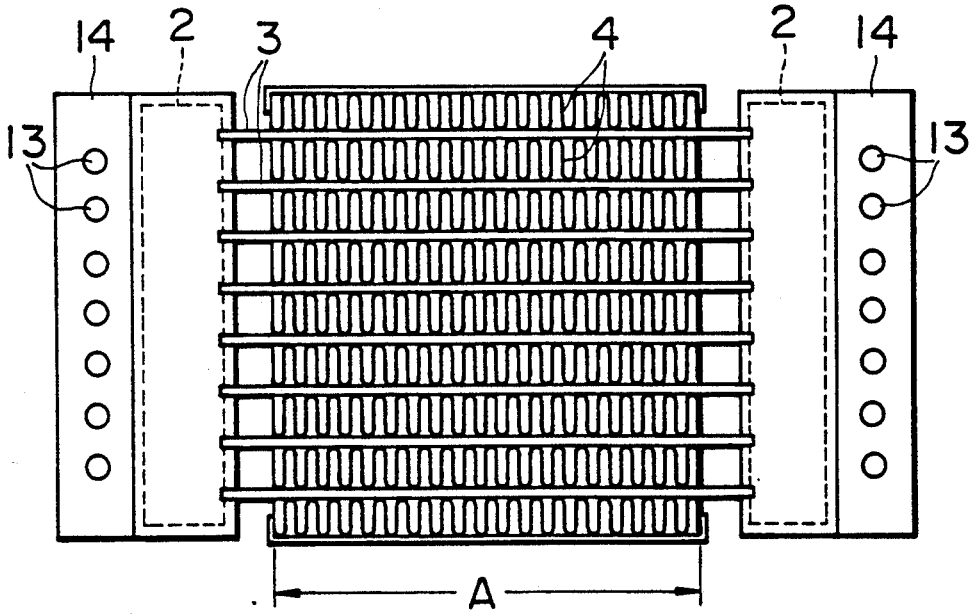
FIG. 4 is an elevational view of a conventional heat exchanger with mounting brackets illustrated for comparison with the heat exchanger shown in FIG. 1.

The advantages of such an attachment structure according to the present invention will be understood from the comparison of FIG. 1 with FIG. 4. FIG. 4 illustrates a conventional heat exchanger in which the area of the region equipped with fin units (indicated by width "A" in FIGS. 1 and 4) is designed to be equal in length to that in FIG. 1, and attachment holes 13 are positioned on the outer sides of brackets 14 as described in the prior art. As is understood from the comparison of FIG. 1 with FIG. 4, the total width of the heat exchanger including the brackets of FIG. 1, i.e., the width between the outer end of one bracket 6 and the outer end of the other bracket 6, can be decreased as compared with that in FIG. 4. Therefore, in this case, the total size of the heat exchanger of FIG. 1 can be decreased while maintaining the heat exchange capability and capacity of the heat exchanger of FIG. 4.

Figure 5:
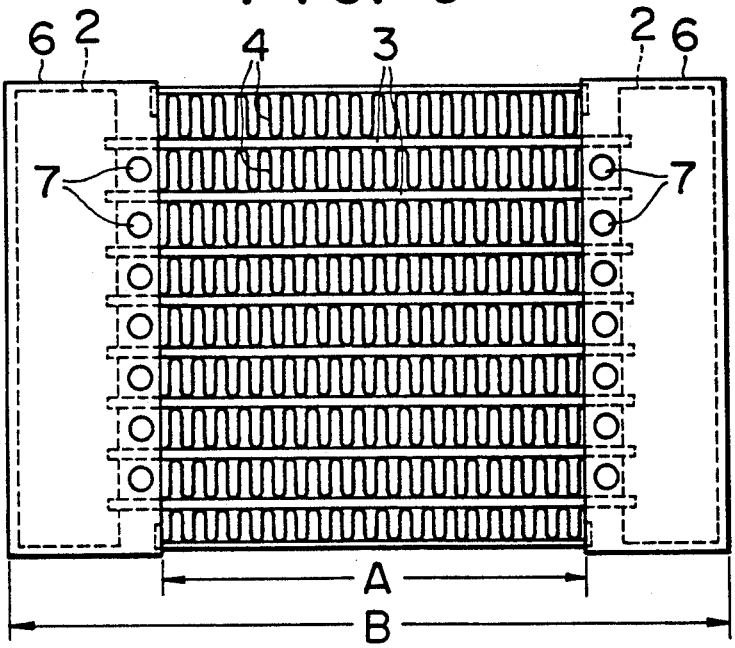
FIG. 5 is an elevational view of a heat exchanger with mounting brackets according to a second embodiment of the present invention.
Figure 6:
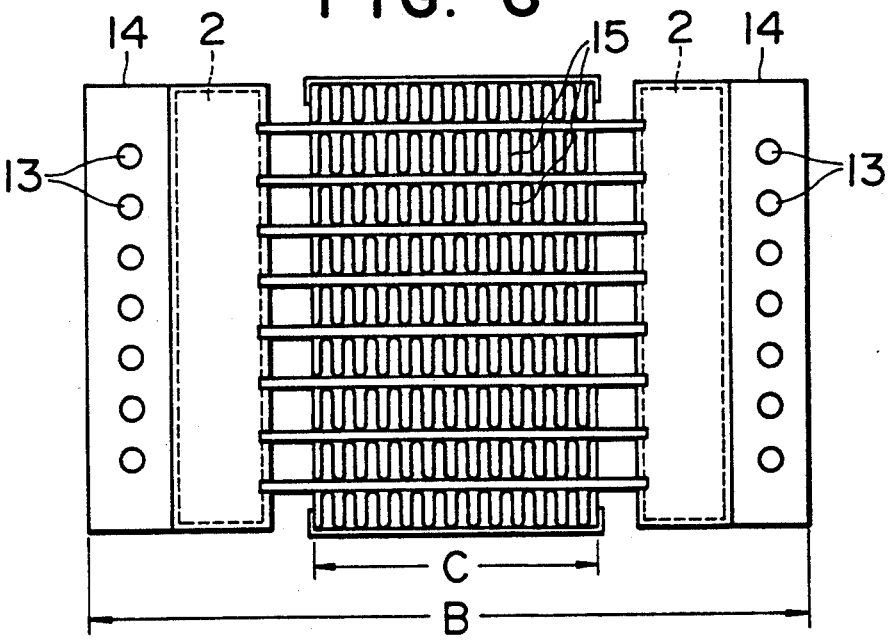
FIG. 6 is an elevational view of a conventional heat exchanger with mounting brackets illustrated for comparison with the heat exchanger shown in FIG. 5.
Figure 7:
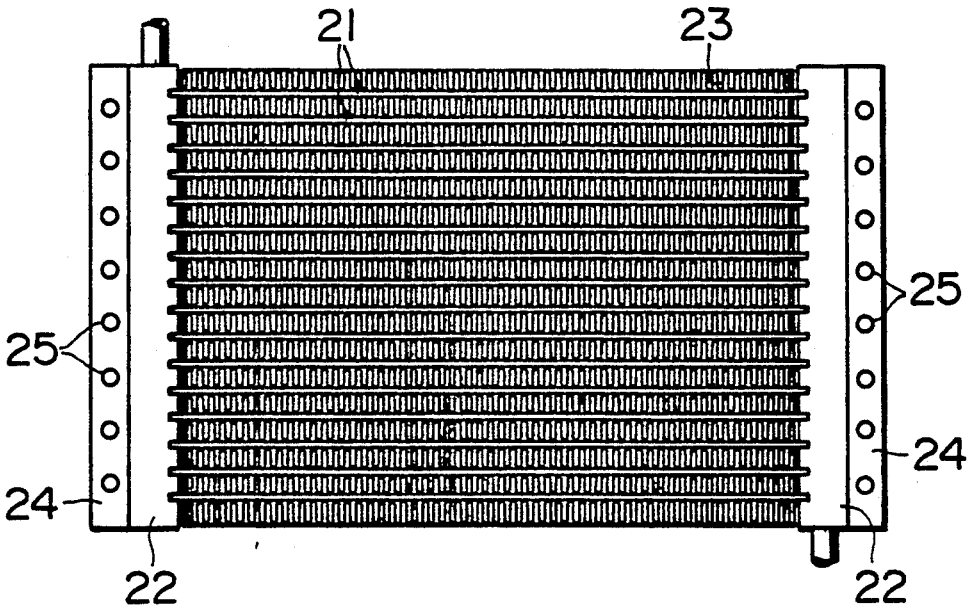
FIG. 7 PRIOR ART
FIG. 7 is an elevational view of a conventional heat exchanger.
Figure 8:
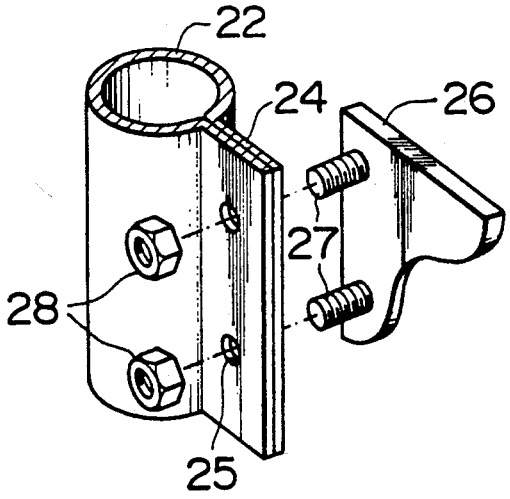
FIG. 8 PRIOR ART
FIG. 8 is an exploded perspective view of a part of the heat exchanger shown in FIG. 7.

FIG. 5 illustrates a heat exchanger equipped with mounting brackets according to a second embodiment of the present invention. FIG. 6 also illustrates a conventional heat exchanger. Although the heat exchanger shown in FIG. 5 is illustrated in the same dimensions as those of FIG. 1, FIG. 5 shows a heat exchanger in which the total width "B" of the heat exchanger including brackets is designed to be equal to that of the heat exchanger shown in FIG. 6. As is understood from the comparison of FIG. 5 with FIG. 6, if the total width "B" of the heat exchanger of FIG. 5 is designed to be equal to that of the heat exchanger of FIG. 6, the distance between the pair of header pipes 2 can be increased as compared with that in the heat exchanger of FIG. 6. Moreover, the length of each fin unit 4 in FIG. 5 can be increased in a direction along the heat transfer tubes 3 as compared with that of each fin unit 15 of the heat exchanger of FIG. 6. As a result, the area of the region equipped with fin units "A", i.e., the effective heat exchange region, can be increased as compared with the area of the region equipped with fin units "C" in the heat exchanger of FIG. 6. Therefore, the heat exchange capability and capacity can be increased in the heat exchanger of this invention, while maintaining a small total width.

Although several preferred embodiments of the present invention have been described in detail herein, it will be appreciated by those skilled in the art that various modifications can be made without materially departing from the novel and advantageous teachings of the invention. Accordingly, the embodiments disclosed herein are by way of example. It is to be understood that the scope of the invention is not to be limited thereby, but is to be determined by the claims which follow.

What is claimed is:

1. In a heat exchanger including a pair of header pipes extending in parallel relation to each other, a plurality of parallel heat transfer tubes fluidly interconnected between said pair of header pipes, a plurality of fin units extending between adjacent heat transfer tubes of said plurality of parallel heat transfer tubes, and at least one bracket in which at least one of said pair of header pipes is supported and which has a plurality of attachment holes for attaching said at least one bracket to an external member via fasteners inserted through said attachment holes, the improvement comprising:

each of said plurality of attachment holes being located at a position between said adjacent heat transfer tubes and between said at least one of said pair of header pipes and one of said fin units.

2. The heat exchanger as recited in claim 1 wherein said bracket is provided for each of said header pipes.

3. The heat exchanger as recited in claim 1 wherein said attachment holes are positioned between every two adjacent heat transfer tubes.

4. The heat exchanger as recited in claim 1 wherein said bracket is constructed from a plate material.

5. The heat exchanger as recited in claim 4 wherein said bracket is formed with a U-shaped cross-section.

6. The heat exchanger as recited in claim 1 wherein said fasteners comprise bolts.

7. The heat exchanger as recited in claim 1 wherein a holder is inserted into said bracket for securing an end portion of said header pipe that is supported by said bracket.

8. The heat exchanger as recited in claim 7 wherein said holder has a recessed portion in which said end portion of said header pipe is held.

* * * * *